US008146392B2

(12) United States Patent
Töpfer

(10) Patent No.: US 8,146,392 B2
(45) **Date of Patent: *Apr. 3, 2012**

(54) MULTIPOINT DOOR/WINDOW LOCK WITH PANIC OVERRIDE

(75) Inventor: Stefan Töpfer, Velbert (DE)

(73) Assignee: Carl Fuhr GmbH & Co. KG, Heiligenhaus (DE)

( * ) Notice: Subject to any disclaimer, the term of this patent is extended or adjusted under 35 U.S.C. 154(b) by 776 days.

This patent is subject to a terminal disclaimer.

(21) Appl. No.: 12/002,521

(22) Filed: Dec. 17, 2007

(65) Prior Publication Data

US 2008/0156048 A1 Jul. 3, 2008

(30) Foreign Application Priority Data

Dec. 16, 2006 (DE) ..... 10 2006 059 568

(51) Int. Cl.
*E05C 1/06* (2006.01)

(52) U.S. Cl. ..... 70/107; 70/77

(58) Field of Classification Search ..... 70/91–92, 70/77, 101, 103, 104, 106–108, 110–111, 70/145, 144, 468; 292/34, 35, 39
See application file for complete search history.

(56) References Cited

U.S. PATENT DOCUMENTS

| | | | | |
|---|---|---|---|---|
| 4,838,053 | A * | 6/1989 | Shen | 70/92 |
| 5,513,505 | A * | 5/1996 | Dancs | 70/107 |
| 6,389,855 | B2 * | 5/2002 | Renz et al. | 70/107 |
| 7,677,067 | B2 * | 3/2010 | Riznik et al. | 70/107 |
| 7,818,984 | B2 * | 10/2010 | Hwang | 70/107 |

FOREIGN PATENT DOCUMENTS

| | | | |
|---|---|---|---|
| DE | 10 2004 012 108 | | 9/2005 |
| EP | 1234938 | * | 8/2002 |
| EP | 1574644 A | | 9/2005 |

* cited by examiner

*Primary Examiner* — Kristina Fulton
(74) *Attorney, Agent, or Firm* — Andrew Wilford

(57) ABSTRACT

A latch has a housing and a dead bolt shiftable on the housing between extended and retracted positions. A latch nut is rotatable on the housing and connectable to door handles and carries actuating and panic levers. An actuating element is connected between the dead bolt and the actuating lever, and a panic element is connected between the panic lever and a locking pawl and is movable between an unactuated position and an actuated position to shift the locking pawl into an unlocked position. A key cylinder on the housing has a movable actuating lug movable between a locking end positing and a freeing end position. A pivotal locking pawl is shiftable by movement the actuating lug of the key cylinder into a locked position blocking movement of the actuating element and holding the dead bolt in the extended position and an unlocked position freeing the bolt and actuating element.

16 Claims, 8 Drawing Sheets

MULTIPOINT DOOR/WINDOW LOCK WITH PANIC OVERRIDE

FIELD OF THE INVENTION

The present invention relates to a multipoint or espagnolette lock for a door or window. More particularly this invention concerns such a lock that can be operated by a key and that also has a panic override function.

BACKGROUND OF THE INVENTION

A lock for doors, windows, and the like, in particular an espagnolette lock with a panic function and multi-point bolting mechanism, has a latch- and key-actuated main lock unit with a spring bolt, a dead bolt, an actuating nut, and a key cylinder. The actuating nut is effective via an actuating element on the dead bolt and auxiliary latches and has an actuating lever as well as a panic lever. The actuating lever cooperates with the actuating element and the panic lever cooperates with a panic element. A pivotal locking pawl is movable by means of an actuating lug of the key cylinder from an unlocked position in which the actuating element is released to a locked position blocking the actuating element. The locking pawl is movable by means of the panic operating element when the latch is actuated (from the inside of the door) from the locked position to the unlocked position.

Such lock is known from DE 10 2004 012 108. The auxiliary latches located above and below the primary lock housing may be extended by pivoting the inside or outside handle upward, assuming as is standard the handle is a lever that extends horizontally and is pivoted at its end remote from the hinge edge of the door or window sash. Subsequently, this prebolted state may be converted into a locked setting by way of the locking pawl using the key cylinder. Thus, the dead bolt is blocked from unauthorized opening from outside via the key cylinder. From inside the door, it is possible for all bolting points to be retracted at any time by simply pivoting the inside down handle downward. Due to the structure of the four-part actuating nut with its two actuating nut parts, the panic lever, and the actuation lever, as well as taking into account the two associated handle shafts of different lengths, this door lock has a latch-actuated, multi-point panic lock that may be used on left- and right-hand doors.

The side of the lock on which the panic function should be located is determined by the installer by inserting the appropriate handle shaft in the inside part of the nut of the mechanism. The long handle shaft always actuates the panic lever and defines the inside of the door. With the exception of the conversion of the spring bolt, which is known per se and done simply by turning it over, no further adjustments to the locking mechanism need be made.

In the known locking mechanism, a DIN key cylinder, for example, a DIN profile cylinder, is used for key actuation from both sides. Because the locking pawl, which is also referred to as an inner bolt, is actuated for bolting purposes directly via the actuating lug of the profile cylinder, the possibility exists that the lug may remain in an undefined position if the key is not removed, such that panic actuation is also blocked by way of the latch actuating nut.

In conventional locking mechanisms without a panic function, it is also known to use key cylinders with an interior knob based on a DIN key cylinder. These key cylinders cannot be turned 360°; rather, they have stops that limit rotation to approximately 135°. In practice, cylinders of this type are referred to as "90°" cylinders. Normally, key cylinders of this type are installed in such a way that the knob is located on the inside of the door, as is required on a fire door. The stops in these cylinders create an indicator on the inside of the door of the door's locked state (for example, the knob being horizontal) and its prebolted or unbolted state (for example, the knob being rotated by 135°). Key cylinders of this 90° type cannot be easily combined with a panic function because, due to their limited rotational axes, the danger exists of the actuating lug disrupting the panic function. In addition a 90° key cylinder of would not reliably display the correct bolting state via its indicator, for example, the knob, in a conventional locking mechanism.

OBJECTS OF THE INVENTION

It is therefore an object of the present invention to provide an improved lock.

Another object is the provision of such an improved lock, in particular a multipoint lock, that overcomes the above-given disadvantages, in particular that guarantees a practical and, in particular, malfunction-free panic function in a simple and cost-effective manner, even when using a key cylinder without a lost-motion function as well as a 90° key cylinder.

SUMMARY OF THE INVENTION

A latch for a door or window has according to the invention a housing adapted to be mounted on the door or window, a spring bolt shiftable on the housing between an extended position and a retracted position, and a dead bolt shiftable on the housing between an extended position and a retracted position. A latch nut is rotatable on the housing and connectable to inside and outside door handles and carries an actuating lever and a panic lever. An actuating element is connected between the dead bolt and the actuating lever, and a panic element is connected between the panic lever and the locking pawl is and movable between an unactuated position and an actuated position to shift the locking pawl into the unlocked position. A key cylinder on the housing has a movable actuating lug movable between a locking end positing and a freeing end position. A pivotal locking pawl is shiftable by movement the actuating lug of the key cylinder into a locked position blocking movement of the actuating element and holding the dead bolt in the extended position and by movement of the lug into the freeing position into an unlocked position freeing the bolt and actuating element. The locking pawl is coupled in the locked position to the lug such that movement of the panic element into the actuated position shifts the lug into the freeing position.

In other words, in order to attain this object, the invention teaches that, in a generic locking mechanism of the type described at the outset, the locking pawl operatively connected with the actuating lug of the key cylinder in such a way that, during unlocking, it moves the actuating lug from the a blocking position arresting the dead bolt, out of contact with the dead bolt and into a release position via the panic operating element. Here, the invention is based on the insight that a blockage-free panic opening may be guaranteed even when using a closing or profile cylinder without a lost-motion function as well as when using a 90° key cylinder if, in addition to the actuating lug acting on the locking pawl during the locking process, the locking pawl also acts on the key cylinder and/or its actuating lug such that the locking pawl constantly ensures via this dual-sided operative connection that the actuating lug is moved out of any possible blocking position if the locking pawl is pivoted via the panic operating element during panic operation.

To this end, the invention suggests in a particularly preferred embodiment that the locking pawl be in operative connected with the actuating lug of the key cylinder by way of a transmission element. This transmission element is coupled with the actuating lug such that the locking pawl, insofar as it acts on the transmission element, turns the actuating lug out of position at the same time. Here, the transmission element is preferably embodied as a transmission ring rotatable on the key cylinder, with the actuating lug rotationally entraining the transmission ring. Here, it is useful for the transmission ring to have a notch into which the actuating lug engages. The operative connection between the locking pawl on the one side and the transmission ring on the other side may be positive or not. In a particularly preferred embodiment of the invention, the transmission ring has an array of teeth that cooperates with an array of teeth on the locking pawl. Here, it is useful for the teeth on the transmission ring to extend over only a limited portion of the circumference of the transmission ring.

In the context of the invention, the actuating lug of the key cylinder is then surrounded by, for example, a transmission ring on the respective teeth are formed. By rotating the key cylinder, the transmission ring, which is rotationally mounted in a seat of the latch housing, is jointly rotated. If the lock is locked by the key cylinder, the teeth on the ring entrain the inner bolt or locking pawl, which has also been provided with teeth, and thus locks the actuating element. In the case of a panic release by way of the latch actuating nut, the locking pawl is rotated back into its prelocked or unlocked position by the panic operating element. Here, it is particularly significant that the transmission ring surrounding the cylinder also rotates back, with the actuating lug being forcibly taken along.

Here, it is advantageous that a key cylinder that is adjustable only over a limited angular area a, for example, a so-called "90°" cylinder, be used as the key cylinder. This key cylinder may be actuated from one side, almost always the inside, by means of an actuation knob and from the other side by means of a key. In this connection, it is moreover particularly advantageous that the forcibly created operative connection between the locking pawl on the one side and the actuating lug on the other side reliably guarantees that the knob always reliably indicates the locked/unlocked condition of the lock. In addition the danger of blockage mentioned at the outset is prevented. This 90° key cylinder may be embodied as a profile cylinder, but also as a round cylinder or oval cylinder.

However, it also lies within the scope of the invention for a 360° cylinder to be used that may be actuated on either end by a key, also referred to as a DIN key cylinder, for example, a DIN profile cylinder. These 360° cylinders may also be embodied as profile cylinders or round or oval cylinders and are used in high-security situations, in particular on doors with glass panels. Even if a key has been inserted into this key cylinder, the structure according to the invention guarantees that the lock cannot be blocked during panic operation. If, for example, in the case of a DIN cylinder, the two tooth segments are not engaged if the key is not inserted, then the locking pawl is turned back in a return stroke and the transmission ring located around the profile cylinder is not rotated. In spite of this, there is no blockage because the structure with the tooth segment guarantees that such a return stroke only occurs when the actuating lug is in an end position, for example, if the key has been pulled out.

In order to guarantee a particularly reliable functioning in the transitional area between the return stroke of the inner bolt and engagement of the tooth segments, the invention proposes a retaining device for the transmission ring that holds the transmission ring in one or more predetermined end positions. To this end, it may be useful for the retaining device to have at least one spring that is engaged in one or more predetermined positions in a respective spring seat. A spring-loaded ring of this type guarantees a clean tooth engagement in the transitional region described above.

Finally, it is useful for the locking mechanism to have a multipart actuating nut with at least one first nut part and one second nut part, with the actuation element and panic lever arranged between the first and second actuating nut parts element and the panic lever cooperating parts, with the actuation lever cooperating with the actuating element and the panic lever with a panic operating element. The long handle shaft is fitted into the first nut part and, upon actuation, entrains the panic lever as well as the actuation element with a predetermined lost motion, with a short handle shaft that actuates the associated actuation element with a predetermined lost motion being fitted in the second nut part. The panic operating element cooperates with the locking pawl when the long handle shaft is operated by its handle to open the lock.

Overall, the invention is distinguished by comfortable opening of the door from the inside without prior unlocking of the lock using DIN key cylinders with and without a knob as well as 90° cylinders. Only minimal alterations to the components are necessary in order to use different types of cylinders. Sure retraction of the actuating lug is always guaranteed if the actuating lug is engaged. Functional positions in the locking mechanism in which the actuating lug could block panic unlocking are reliably prevented. This is particularly true when 90° cylinders are used. Similarly, the locking state of the door is discernible from the door knob.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
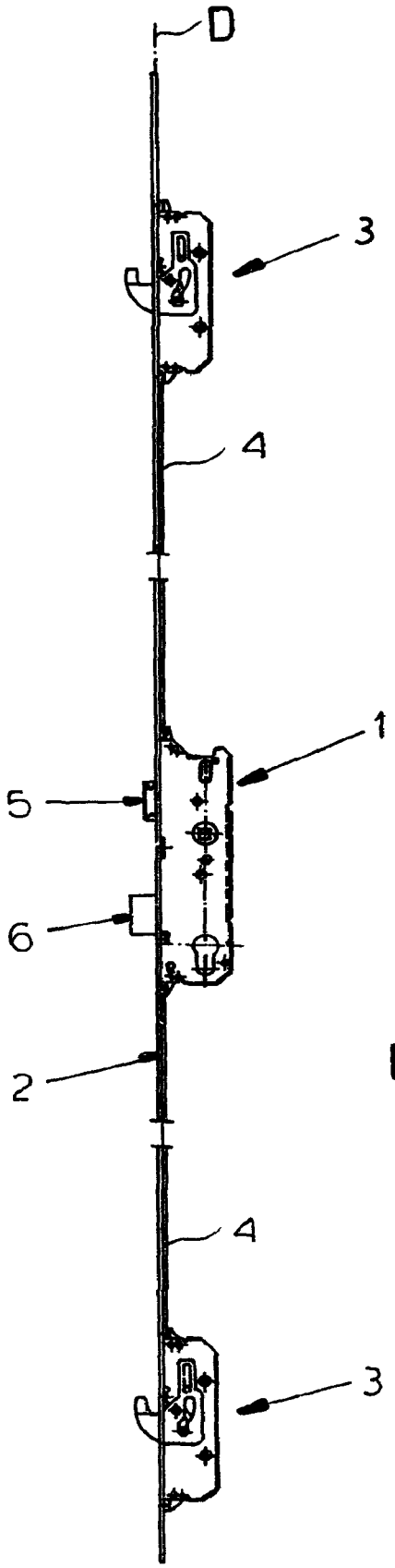
FIG. 1 is a small-scale schematic side view of the lock according to the invention.

As seen in FIG. 1 a multipoint bolting mechanism or lock has a main lock unit 1 and auxiliary latches 3 that are attached to a common mounting plate 2 and that are operated by link bars 4 sliding behind the mounting plate 2, which is fixed to the free edge of a door shown schematically at D. The opposite edge of the door is the hinge edge. In the illustrated embodiment, the auxiliary latches 3 have hook or swing bolts, but pin bolts or the like could also be used.

As shown in FIGS. 2-6, the main lock unit 1, which can be operated by a key or inside and outside handles or knobs 20 and 21 (FIG. 7), has a housing 60 holding a spring-loaded bolt 5, a dead bolt 6, an actuating-nut assembly 7, and a key-operated cylinder 8, here a two sided profile cylinder for multibitted key. The actuating nut 7 is effective via a slide-type actuating bar or element 9 on the dead bolt 6 and on the link bars 4 that operate the auxiliary latches 3. Levers 12 and 13 both centered on an axis A (FIGS. 5 and 6) of the nut 7 are coaxially pivoted between an first actuating-nut part 10 and an second actuating-nut part 11 forming the actuating nut 7 and both pivotal about the axis A in the housing 60. The actuating lever 12 cooperates with the actuating element 9, and the panic lever 13 cooperates with a panic element 14. A long handle shaft 15 fits from inside into the first actuating-nut part 10 in FIG. 5 and into the second part 11 in FIG. 6. When actuated in the first part 10, it entrains the panic lever 13 as well as the lever 12, with some lost motion. A short handle shaft 16 fits from into the second actuating-nut part 11 in FIG. 5 and the first part in FIG. 6. When in the second part 11 it is able to operate the associated lever 12, again with some lost motion.

In addition a pivotal bolt-locking pawl 17 serving as the inside latch can be shifted by the cylinder 8 from an unlocked position to a locked position blocking the actuating element 9 with the dead bolt 6 extended and the auxiliary latches 3 in their locked positions. When the latch is actuated from inside the door via an inside handle 20 carried on the shaft 15, the panic element 14 cooperates with the bolt-locking pawl 17 to unlock the mechanism. The inside actuating-nut part 10 and the outside actuating-nut part 11 have respective arms (not shown) that may be orbited about the axis by a predetermined rotational angle to engage respective cam formations 22 and 23 on the actuating lever 12, with a free travel or lost motion of 45° between the inside actuating-nut part 10 and the actuating lever 12.

The panic lever 13 has an arcuate slot or hole 24 through which fits the cam 22 of the actuating lever 12 with a predetermined freedom of movement and is partially mounted in a recess 25 of the actuating lever 12. The actuating lever 12 is shaped like a fork with a seat 26 (FIG. 3) for an actuation cam 27 on the actuating element 9 and/or on something connected to the actuating element 9. This element 9 moves in a straight line and has a pin shiftable along an angled cam slot in the bolt 5 to move it between its extended position (FIGS. 2-4) and an unillustrated retracted position.

Figure 6:
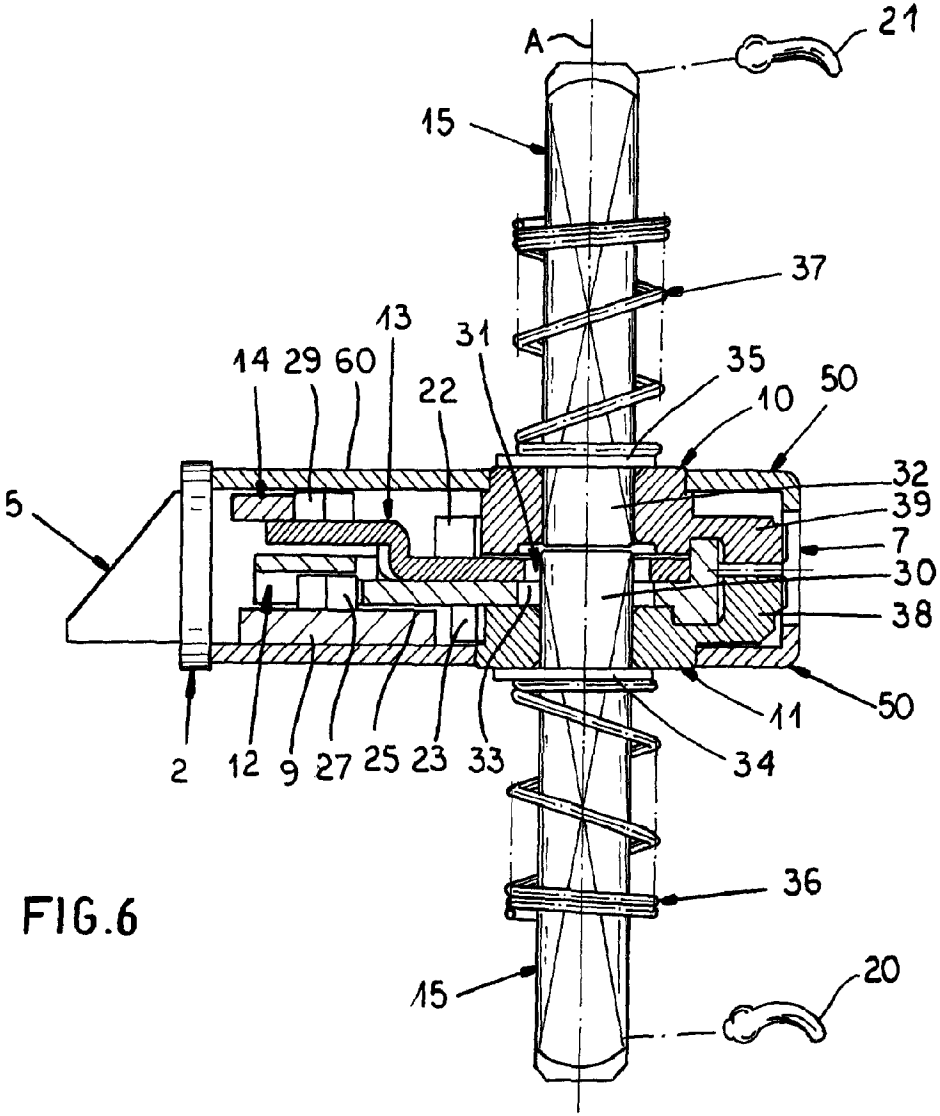
FIG. 6 is a view like FIG. 5 but with the handle shafts reversed.

The panic lever 13 has a control pin 29 acting on a control cam 28 (FIG. 2) on the pivotal panic element 14. The panic lever 13 has a seat for a square end 30 of the long handle shaft 15 that forms a 45° lost-motion coupling 31 for the long handle shaft 15 and its inserted polygonal-section end 30. As shown in FIG. 6, the long handle shaft 15 may also be fitted with its long polygonal-section end 30 into the outside actuating-nut part 11 and the short handle shaft 16 with its short polygonal-section end 32 into the inside actuating-nut part 10, with the long polygonal-section end 30 of the long handle shaft 15 protruding with a predetermined freedom of movement through a circular opening 33 (FIG. 7) in the actuating lever 12 into the lost-motion coupling 31 of the panic lever 13 for its actuation. Here, the inside of the door is always defined by the side on which the long handle shaft 15 is inserted, so that the part 10 can be the "inside" or the "outside part" and vice versa for the part 11, depending on the installation of the shafts 15 and 16.

Figure 7:
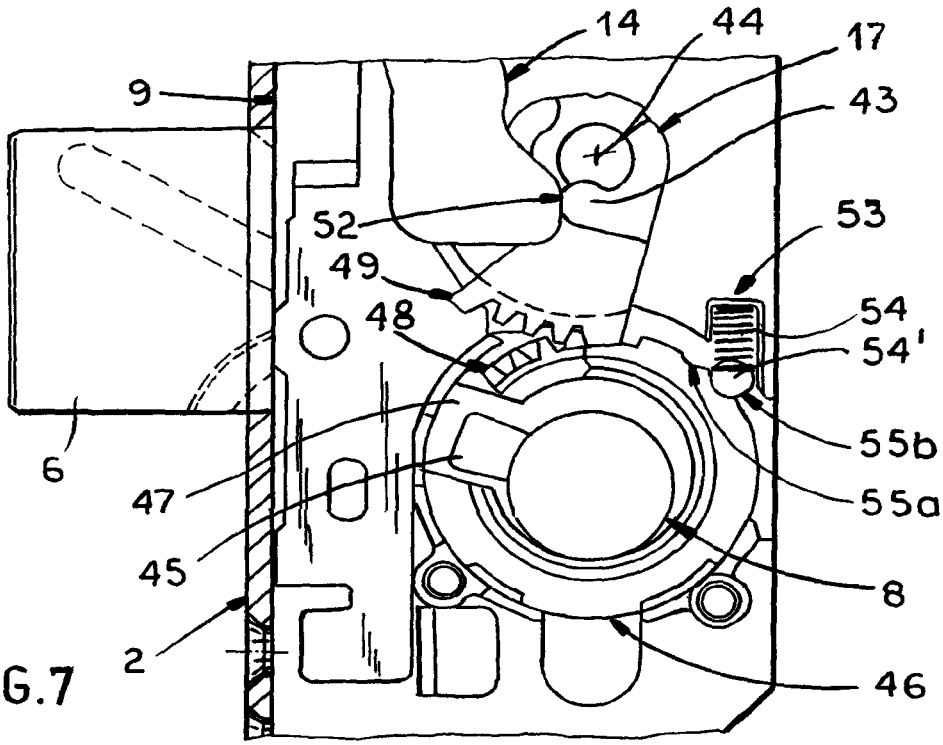
FIG. 7 is a large scale view of a detail of FIG. 2 in an alternative arrangement.

FIG. 7 shows the latch actuating nut 7 in cross section. It can be seen that, by switching the handle shafts 15 and 16, a right- or left-hand door can be fitted with the latch according to the invention. In this case the spring bolt 5, which is symmetrical, also needs to be turned over. Thus a single model of the lock according to the invention can be used on right- and left-handed doors.

The handle shafts 15 and 16 have respective flanges 34 and 35 formed for example by retaining washers that sit at outer ends of their polygonal-section ends 30 and 32 and are surrounded by respective compression springs 36 and 37 braced between these flanges/washers 34 and 35 and the respective face of the door or a housing 60 of the latch unit 1. The actuating nut parts 10 and 11 have respective indentations or projections 38 and 39 on their sides turned away from the actuating element 9 which are braced against one or two spring-loaded return elements shown schematically at 61 in FIG. 2 that bias them angularly into a center position. The pivotal panic element 14 may be operated by pivoting it against a cam edge 43 of the locking pawl 17 below a pivot axis 44 of the locking pawl 17.

According to this invention, the locking pawl 17 is in an operative connection with a radially projecting lug 45 of the cylinder via a transmission ring 46 rotationally mounted on the cylinder 8. The actuating lug 45 rotationally entrains the transmission ring 46 and vice versa. To this end, the transmission ring 46 has a radially inwardly open notch 47 in which the lug 45 engages. In addition it can be seen that the transmission ring 46 has teeth 48 that mesh with a segmental array of teeth 49 of the locking pawl 17. Here, the teeth 48 of the transmission ring 46 extend in an arc over only a limited portion of the outer periphery of the ring 46. The transmission ring 46 is can limitedly rotate in a seat 51 formed by the lock housing 60.

Figure 9A:
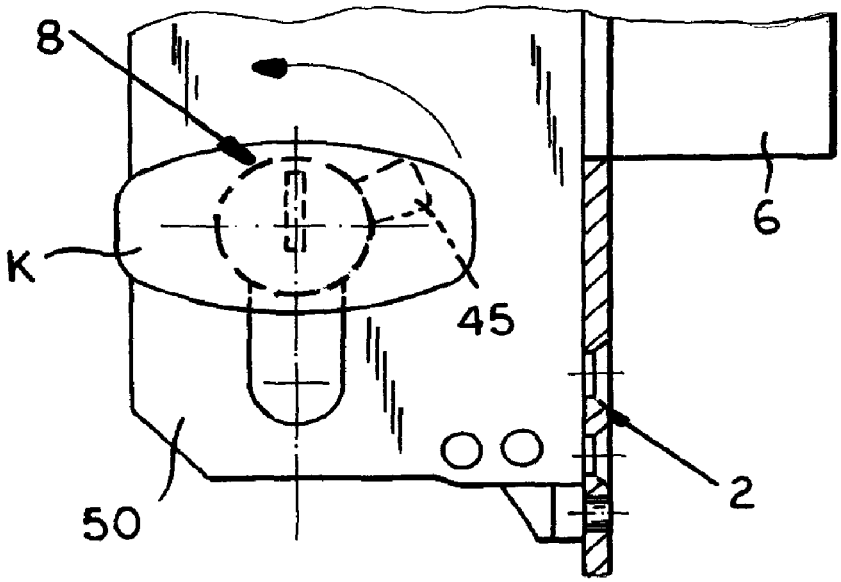
FIGS. 9*a* and 9*b* are end views illustrating different positions of the key cylinder.
Figure 9B:
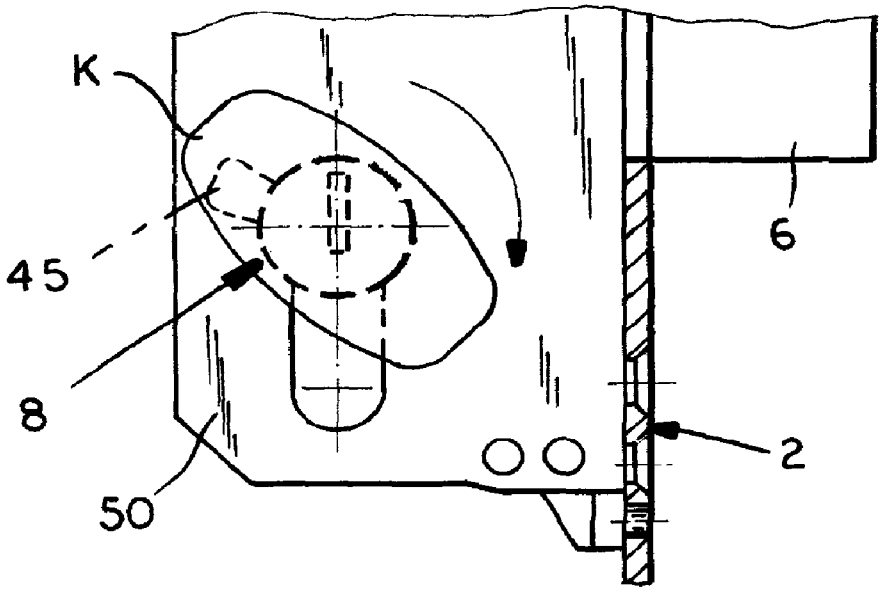

In the illustrated embodiment, the key cylinder 8 is embodied as a key cylinder that may be displaced as shown in FIGS. 9*a* and 9*b* only over a limited angle, here 90°, and may be actuated from the one side, normally the inside, by means of an actuating knob K and, from the opposite side, normally the outside, by means of an unillustrated key.

The lock according to the invention operates as described below, with reference to FIGS. 2 to 9.

In a starting position the long handle shaft 15 is fitted to the first nut part 10 along with the long polygonal-section end 30 and the short handle shaft 16 with the short polygonal-section end 32 is fitted to the second nut part 11. The angled spring bolt 5 is urged into an outwardly projecting position by a spring.

Figure 2:
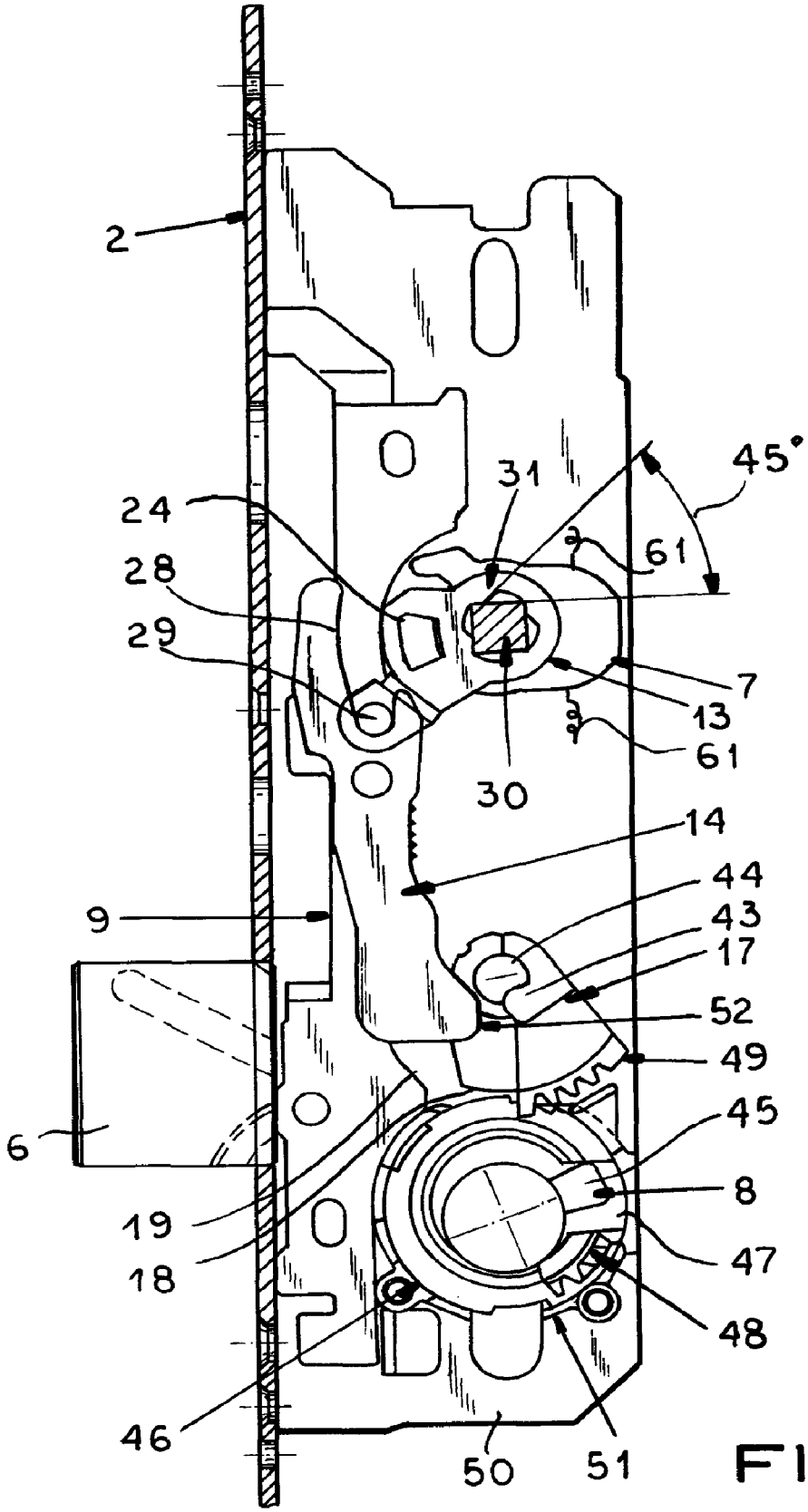
FIG. 2 is a larger-scale side view of the main lock unit without its housing and in the prelocked position.

Then as shown in FIG. 2, the first nut part 10 is rotated 45° counterclockwise by the long handle shaft 15 by its handle. This action also rotates the actuation lever 12 and the panic lever 13 about the axis A. The control pin 29 of the panic lever 13 pivots the panic operating element 14 clockwise. The actuating element 9 is displaced downward approximately 20 mm by the actuation lever 12. In this manner, the auxiliary latches 3 and the dead bolt 6 are extended into the bolted position. The second nut part 11 does not rotate along. If the door latch and, as a result, the long handle shaft 15, are released, the actuating nut 7 will be returned by the springs 61. The actuation lever 12 and the panic lever 13 do not move back along with the actuating nut. Due to the lost-motion coupling, they remain in the position they previously assumed. According to FIG. 3, by counterclockwise rotation of the key cylinder 8 and/or its entraining nose 45, the locking pawl 17 is rotated clockwise and a locking position blocking the actuating element 9 is conveyed. In the bolted position according to FIG. 3, the locking pawl 17 blocks the actuating element 9 in that the blocking flank 18 of the latch bolt 17 rests against the blocking flank 19 of the actuating element 9, such that the actuating element cannot be moved back (upward).

Figure 3:
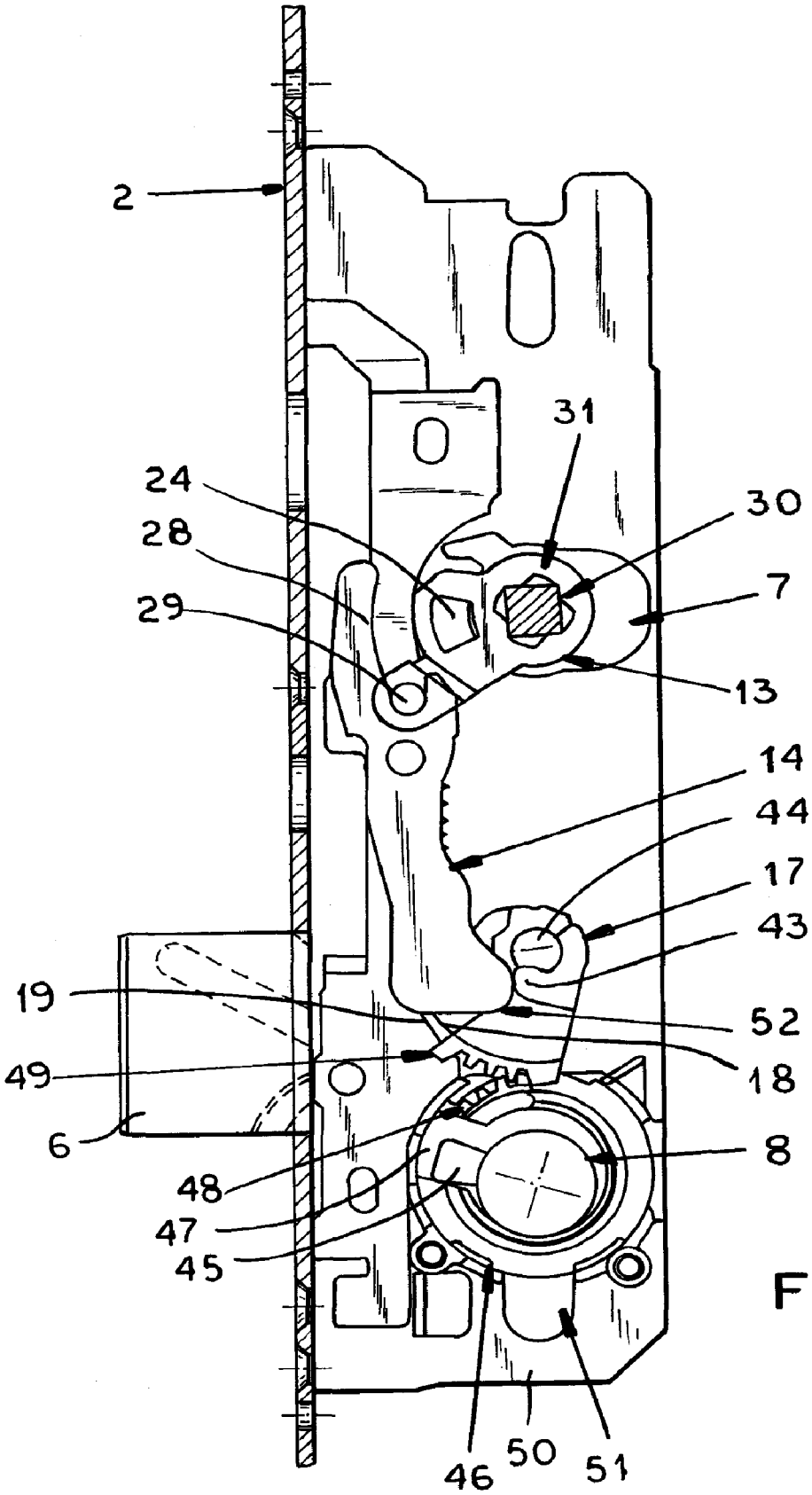
FIG. 3 is a view like FIG. 2 but in the locked position.

Here, a comparative viewing of FIGS. 2 and 3 shows that, by the rotation of the profile cylinder 8, the ring 46, which is mounted in the seat 51, is always forcibly rotated along. If the lock is bolted via the profile cylinder 8, the tooth segment 48 located on the ring 46 entrains the inner bolt 17, which is mounted in the lock and also provided with a tooth segment 49, and in so doing locks the actuating element 9 (cf. FIG. 3).

The short handle shaft 16, with its short polygonal-section end 32, reaches only into the second nut part 11. By the rotation of the short handle shaft 16 by way of the door latch in the clockwise direction, the second nut part 11, and thus the actuation lever 12 as well, is rotated along with it. The actuating element 9 may be displaced by approximately 3 mm in the opening direction. The second nut part 11 cannot be rotated any farther because the inner bolt 17 is blocking the actuating element 9 and therefore also the actuation lever 12. It is not possible to open the door lock using the short handle shaft 16 on the outside of the door. During the attempt to open the door, the first nut part 10 remains spring loaded and in its initial position. Nor does the panic lever 13 rotate along. According to FIG. 4, the long polygonal-section end 30 of the long handle shaft 15 on the inside of the door extends into the actuating nut 7. Here, the first nut part 10 and the panic lever 13 located in the center of the actuating nut group are penetrated by the long polygonal-section end 30. If the latch is actuated on the inside of the door, the panic lever 13 will also be pivoted in a clockwise direction along with the first nut part 10 and the actuation lever 12. By pivoting the panic lever 13, the panic operating element 14 is rotated in a counterclockwise direction. As a result, a lower control surface 52 of the panic operating element 14 presses against the inner bolt 17 and/or its bolt cam 43. The inner bolt 17 is pivoted counterclockwise in the opening direction. After the actuating nut has been rotated by only approximately 4° to 8°, the inner bolt 17 releases the actuating element 9 and allows the multi-point bolting mechanism to be opened by continued rotation. By the continued rotation of the first nut part 10, the panic lever 13, and the actuation lever 12 to 45°, all auxiliary latches 3, the dead bolt 6, and, finally, the spring bolt as well are completely retracted.

After the door latch has been released, the first nut part 10 pivots back into its initial position in a spring-loaded manner, which is not shown. Due to the lost-motion coupling, the actuation lever 12 as well as the panic lever 13 remain in position. The locking mechanism is now back in its basic open or unlocked position.

Figure 4:
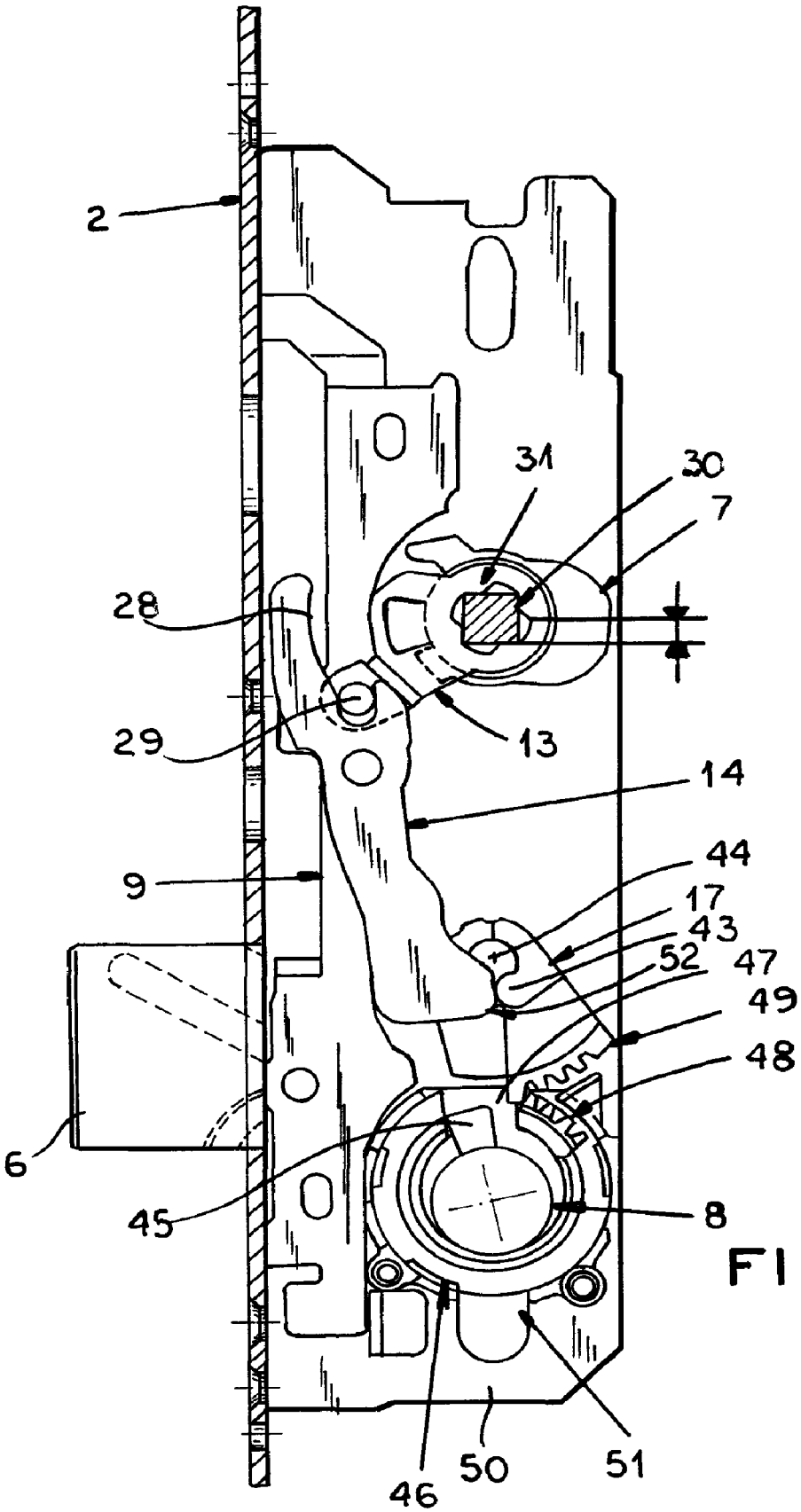
FIG. 4 is a view like FIG. 2 but in the position when panic actuated from inside.

A comparison of FIGS. 3 and 4 shows that, during panic actuation via the latch actuating nut 7, the actuating lug 45 is forcibly entrained by the operative connection between the locking pawl 17 and the actuating lug 45. The knob K on the 90° cylinder therefore always indicates the bolt setting of the lock. In this regard, reference is made to FIGS. 9*a* and 9*b*, with FIG. 9*a* showing the knob K in the position indicating that the latch is locked. The opening direction is indicated by an arrow in FIG. 9*a*. FIG. 9*b* shows the opened or prebolted position. The locking direction is also implied by an arrow.

Figure 5:
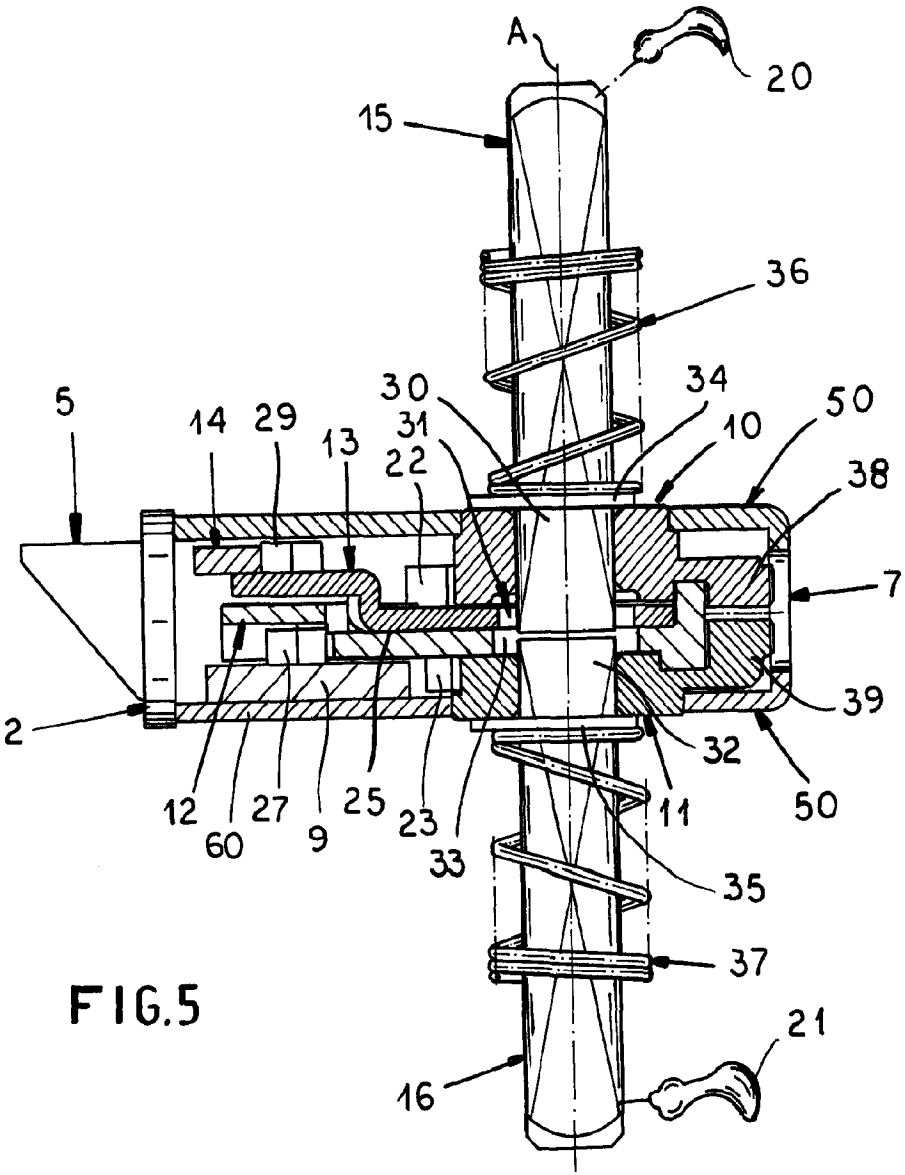
FIG. 5 is a partly schematic horizontal section through the actuating-nut assembly.

FIGS. 5 and 6 show conversion of assembly by switching the handle shafts 15 and 16 and, as a result, the inside of the door being switched. Thus the lock according to the invention can be used on a right- or left-hand door simply by switching these shafts 15 and 16 and turning over the spring bolt 5.

In addition FIG. 7 shows that, in an advantageous embodiment, a retaining device 53 may coact with the transmission ring 46 by holding the transmission ring 46 in one or more angularly offset predetermined positions. To this end, the retaining device 53 has at least one spring element 54 that can engage in two different predetermined seats 55*a* and 55*b* formed on the outer periphery of the ring 46. This guarantees that the ring 45 does not remain in a transitional area or intermediate position between a return stroke of the inner bolt 17 and the engagement of the teeth 48 and 49, such that it is pushed either all the way into the tooth segment 49 of the inner bolt 17 or completely out of it. In this manner, blockage is reliably prevented in this area as well. The spring element 54 may, for example, be embodied as a helical spring that is supported with its end on the lock housing and to whose other end an engagement element 54', for example, a sphere or a cylinder, is attached that engages in the respective spring seat.

Figure 8:
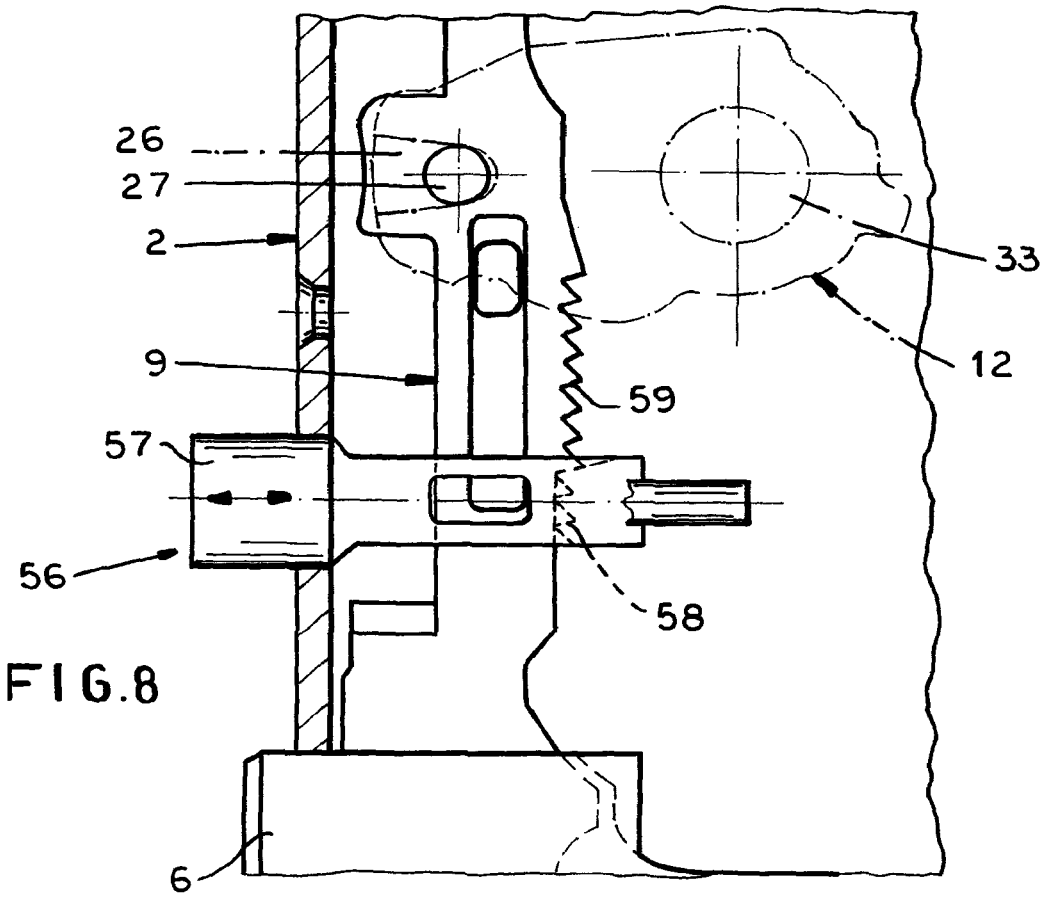
FIG. 8 is a large-scale side view of a detail of a variant of the mechanism as shown in FIG. 2.

Finally, FIG. 8 shows how the lock according to the invention may be equipped with an assembly that blocks the lock in case of malfunction. To this end, for example, a spring-loaded malfunction pin or bolt 57, which is angled and spring-loaded like the spring bolt 5, that may be pushed into the lock housing 60 may be displaceably mounted between the spring bolt 5 and the dead bolt 6. This malfunction lever cooperates either to release or block the actuating element 9. To this end, the malfunction lever 57 is provided with a row of teeth 58 that can engage with a row of teeth 59 formed on the actuating element 9. This guarantees that the actuating element 9 is movable only if the malfunction lever 57 is pushed in. This in turn guarantees that the actuating element 9 may only be actuated if the door is engaged in an appropriate door space, for example, a frame or a sash. As a result, the lock may not be actuated with the door standing open, such that an inadvertent extension of the bolt 6, which would no long allow the door to be closed, is prevented.

The mechanism of this lock is similar in many respects to that of our Ser. No. 12/002,520 filed concurrently herewith, and whose entire disclosure is herewith incorporated by reference.

I claim:

1. A latch for a door or window, the latch comprising:

a housing adapted to be mounted on the door or window;

a spring bolt shiftable on the housing between an extended position and a retracted position;

a dead bolt shiftable on the housing between an extended position and a retracted position;

a latch nut rotatable on the housing and connectable to inside and outside door handles;

an actuating lever on and shiftable by the nut;

an actuating element connected between the dead bolt and the actuating lever such that the dead bolt is moved into the respective retracted position on shifting of the actuating lever by the nut;

a panic lever on and shiftable by the nut;

a panic element connected to the panic lever and movable between an actuated position and an unactuated position;

a key cylinder on the housing having an actuating lug movable between a locking end position and a freeing end position;

a pivotal locking pawl shiftable by the actuating lug of the key cylinder into a locked position blocking movement of the actuating element and holding the dead bolt in the extended position and by movement of the lug into the freeing position into an unlocked position freeing the bolt and actuating element, the pawl being connected to the panic element and shiftable on movement of the panic element between the unactuated position and the actuated position, the locking pawl being coupled in the locked position to the lug such that, for a panic opening of the door, movement of the panic element into the actuated position shifts the lug into the freeing position and allows the pawl to move into the unlocked position and the dead bolt to move into the retracted position;

a transmission ring rotatable on the key cylinder and coupled between the actuating lug and the locking pawl; and respective arrays of interengageable teeth on the ring and pawl.

2. The lock defined in claim 1 further comprising:

auxiliary latches on the door or window spaced from the housing, and respective links extending between the auxiliary latches and the actuating element.

3. The lock defined in claim 2 wherein the ring has a radially open notch in which the lug is fitted.

4. The lock defined in claim 3 wherein the lug fits with angular play in the notch.

5. The lock defined in claim 1 wherein at least one of the arrays of teeth is formed as a segment gear.

6. The lock defined in claim 1 wherein the housing is formed with a seat in which the ring can rotate.

7. The lock defined in claim 1 wherein the cylinder can only orbit the lug through an angle of substantially less than 360°.

8. The lock defined in claim 1 wherein the cylinder has two opposite ends and is operable by a key from one of the ends and is provided with a manually actuatable knob on the other of the ends.

9. The lock defined in claim 1 wherein the cylinder has two opposite ends and is operated from each of the ends by a key.

10. The lock defined in claim 1, further comprising retaining means for releasably retaining the transmission ring in a pair of angularly offset end positions.

11. The lock defined in claim 1 wherein the nut has a pair of coaxial parts and the panic lever and the actuating lever each have an end between the parts, the lock further comprising:

a long shaft extending through one of the nut parts and into the panic and the actuating lever;

a short shaft extending into the other of the nut parts but not into the panic lever.

12. The lock defined in claim 1 wherein the actuating lever is pivotal on the nut.

13. The lock defined in claim 1, further comprising a connecting link extending between and connecting the key cylinder to the panic element.

14. The lock defined in claim 1 wherein the nut is connected via the panic lever with the panic element and therethrough to the spring bolt.

15. The lock defined in claim 13 wherein the connecting link has a formation in operative engagement with the key cylinder.

16. The lock defined in claim 1, further comprising a lost-motion coupling between the transmission ring and the key cylinder.

* * * * *